US007760105B2

(12) United States Patent
Turner

(10) Patent No.: US 7,760,105 B2
(45) Date of Patent: Jul. 20, 2010

(54) HOUSEHOLD PLUMBING LEAK DETECTOR UTILIZING WATER ACTIVATED BATTERY

(76) Inventor: John Bert Turner, 14300 Quiet Meadow Dr., Reno, NV (US) 89511

( * ) Notice: Subject to any disclaimer, the term of this patent is extended or adjusted under 35 U.S.C. 154(b) by 319 days.

(21) Appl. No.: 12/032,683

(22) Filed: Feb. 17, 2008

(65) Prior Publication Data

US 2008/0211680 A1 Sep. 4, 2008

Related U.S. Application Data

(60) Provisional application No. 60/892,850, filed on Mar. 3, 2007.

(51) Int. Cl.
*G08B 21/00* (2006.01)

(52) U.S. Cl. ..... 340/605; 340/616; 340/618; 340/693.1; 429/118

(58) Field of Classification Search ..... 340/605, 340/604, 616, 618, 693.1; 429/118
See application file for complete search history.

(56) References Cited

U.S. PATENT DOCUMENTS 4,246,575 A 1/1981 Purtell
4,297,686 A 10/1981 Tom
4,598,273 A 7/1986 Bryan
4,655,076 A * 4/1987 Weihe et al. ..... 73/73
4,800,372 A 1/1989 Poteet
5,091,715 A 2/1992 Murphy
5,539,383 A * 7/1996 Chin ..... 340/604
6,157,307 A * 12/2000 Hardin ..... 340/604
6,232,883 B1 * 5/2001 Silva et al. ..... 340/539.26
6,354,322 B2 * 3/2002 Clark ..... 137/312
6,526,807 B1 * 3/2003 Doumit et al. ..... 73/40.5 R

* cited by examiner

*Primary Examiner*—Toan N Pham

(57) ABSTRACT

A water detection and alarm system to monitor household plumbing fixtures for leaks. A wick attached to a water activated battery cell connects to a charge accumulator, pulse timer, and audio transducer. The wick draws water from the leak and transports it into the battery cell. A sponge inside the cell absorbs the water and expands, chemically activating the cell, and subsequently providing the electrical energy for the charge accumulator and timer. The timer utilizes the energy stored in the charge accumulator to generate a pulse that drives an audio transducer. No conventional battery is used or required; thus periodic battery replacement is not necessary nor is there a need for a battery monitoring circuit to test for battery depletion.

1 Claim, 1 Drawing Sheet

HOUSEHOLD PLUMBING LEAK DETECTOR UTILIZING WATER ACTIVATED BATTERY

CROSS-REFERENCE TO RELATED APPLICATIONS

This application claims the benefit of provisional patent application Ser. No. 60/892,850, filed Mar. 3, 2007 by the present inventor.

FEDERALLY SPONSORED RESEARCH

Not Applicable

SEQUENCE LISTING OR PROGRAM

Not Applicable

BACKGROUND

1. Field of Invention

This invention relates to liquid leak detectors, specifically those utilized to detect water leakage from plumbing fixtures in a typical household or business.

2. Prior Art

Household plumbing leaks are a common problem. When they go undetected for any length of time the damage and resultant expense can be considerable. A typical household can easily have a dozen or more places where such leaks are likely to occur.

Prior art detectors for such leaks fall primarily into two categories: electro-mechanical and entirely electronic. Electro-mechanical devices typically involve the use of some type of float with an actuator switch to an alarm. U.S. Pat. No. 6,414,598 to Freill (2000) discloses a device of this means.

The more common detectors available on the market today are completely electronic and use some variation of probes or strips with conduction sensing circuits to activate an alarm. U.S. Pat. No. 5,091,715 to Murphy (1992) and U.S. Pat. No. 4,297,686 to Tom (1981) are typical of such embodiments.

Both types of detectors suffer from the same limitation: they require a reliable source of electrical power—usually supplied from a conventional battery. This introduces a significant disadvantage, since now, not only must the device monitor for leaks; it must also monitor its own power source and activate the alarm if the battery gets weak. Descriptions of such prior art reveals that the battery monitoring circuit is often times more complex than the leak detection circuit itself. A dozen or so of these type of detectors located throughout the home, with batteries failing at random intervals, is not a desirable solution.

Other prior art for liquid leak detection systems focus primarily on industrial applications and tend to be complex and elaborate, and as such not practical or economical for household use. Representatives of such prior art are:

U.S. Pat. No. 5,655,561 Wendell
U.S. Pat. No. 5,539,383 Chin
U.S. Pat. No. 4,800,372 Poteet
U.S. Pat. No. 4,598,273 Bryan
U.S. Pat. No. 5,058,421 Alexander
U.S. Pat. No. 4,805,662 Moody
U.S. Pat. No. 4,246,575 Purtell

SUMMARY

In accordance with one embodiment, a liquid leak detector comprised of a wick, water activated battery cell, charge accumulator, electronic pulse timer, and audio transducer.

DRAWINGS—FIGURES

DRAWINGS—REFERENCE NUMERALS

Figure 1:
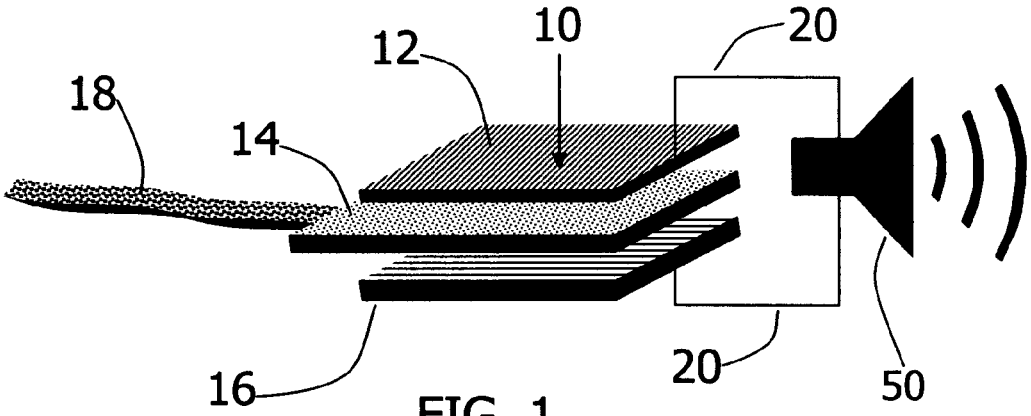
FIG. 1 shows a water activated battery cell with wick connected to an audio transducer.

10 Water Activated Battery Cell
12 cuprous iodide plate
14 layer of sponge material
16 layer of magnesium material
18 wick material
20 wire conductor
30 capacitor (charge accumulator)
40 pulse timer circuit
50 audio transducer

DETAILED DESCRIPTION—FIGS. 1 AND 2

FIG. 1 shows a simplified embodiment of the device. The water activated battery cell (10) consists of a cuprous iodide plate (12), a center layer of sponge material (14), a bottom layer of magnesium material (16), and a wick (18). The cell is connected directly to audio transducer (50) with conducting wires (20)

Figure 2:
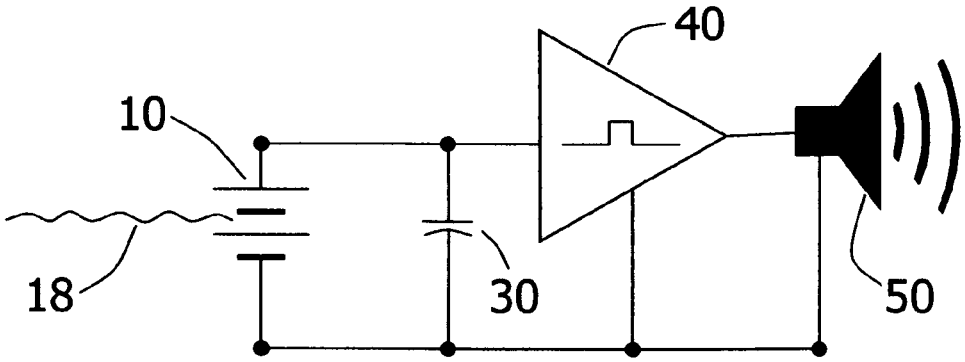
FIG. 2 shows a schematic diagram of water activated batter cell, charge accumulator, pulse circuit, and audio transducer.

FIG. 2 depicts a schematic diagram of a more practical but slightly more complex embodiment of the device. The battery cell (10) is as described above and connects directly to capacitor (30) and pulse timer circuit (40). The pulse timer then connects to audio transducer (50)

OPERATION—FIGS. 1 AND 2

In FIG. 1 a water leak will be absorbed by the wick (18) and transported to the sponge (14), the sponge expands and thereby activates the cell and provides power directly to the audio transducer (50), which subsequently produces a continuous tone alarm.

In FIG. 2 the cell is activated in the same manner as in the description for FIG. 1 above. The charge developed by the battery cell is accumulated and stored by capacitor (30). The pulse timer circuit (40) then utilizes this charge and periodically pulses transducer (50). A reasonable pulse duration would be about 0.2 seconds repeating every one second. This allows for the use of a smaller capacity cell (10), provides a longer cell life once activated, and also produces a more powerful tone from transducer (50).

ADVANTAGES

From the descriptions above, a number of advantages of my leak detector become evident:

(a) The problem of weak and dead batteries is resolved. No power is used by the detector until it becomes activated by the very substance it is designed to detect.

(b) Long life expectancy. The battery remains inert as long as it remains dry.

(c) Convenience and ease of use. The device is physically small and can easily be placed in numerous locations throughout the home. The wick material also doubles as a hanger and allows the device to hang from pipes or placed directly on the floor.

(d) Zero maintenance. No mechanical moving parts, nothing to maintain.

(e) Low cost. Placing multiple devices throughout the home is affordable.

CONCLUSION, RAMIFICATIONS, AND SCOPE

Thus the reader will see that at least one embodiment of the leak detector provides a reliable, portable, and economical device that can alert a homeowner to the existence of a potentially serious indoor plumbing leak.

While my above description contains many specifics, these should not be construed as limitations on the scope of the invention, but rather as an exemplification of several preferred embodiments thereof. Many other variations are possible. For example: The water activated battery described was of the form of magnesium-cuprous chloride. It is recognized that other compounds exist or may be developed that perform the same function—generate electricity when exposed to water. In addition, the charge accumulation and subsequent audio pulsing can be accomplished with numerous electronic means and the audio transducer can also take a variety of common forms.

Accordingly, the scope of the invention should be determined not by the embodiments illustrated, but by the appended claims and their legal equivalents.

The invention claimed is:

1. A household plumbing leak detector with alarm, comprising:

(a) a water activated battery cell wherein an electrolyte necessary to activate the battery cell, and thus chemical generation of electrical energy, is provided by water from a leak being detected, (b) electrical energy generated by said battery cell is accumulated by a capacitive storage device, (c) the electrical energy accumulated in said capacitive storage device is monitored by an electronic pulse and timer circuit, (d) said electronic pulse and timer circuit, upon determining that electrical charge in said capacitive storage device is adequate, uses said accumulated energy to periodically drive an audio transducer and thereby alert homeowner or occupant.

* * * * *